US008137138B2

(12) United States Patent
Dowhower et al.

(10) Patent No.: US 8,137,138 B2
(45) Date of Patent: Mar. 20, 2012

(54) HOUSING BASE FOR AN ELECTRICAL CONNECTOR

(75) Inventors: Kenneth Paul Dowhower, Harrisburg, PA (US); George Harold Douty, Mifflintown, PA (US); Matthew Richard McAlonis, Elizabethtown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 226 days.

(21) Appl. No.: 12/581,613

(22) Filed: Oct. 19, 2009

(65) Prior Publication Data

US 2011/0092103 A1 Apr. 21, 2011

(51) Int. Cl.
*H01R 24/00* (2011.01)

(52) U.S. Cl. ..... 439/626; 439/724; 439/65

(58) Field of Classification Search ..... 439/65, 439/374, 626, 724

See application file for complete search history.

(56) References Cited

U.S. PATENT DOCUMENTS

| | | | | |
|---|---|---|---|---|
| 4,684,190 | A * | 8/1987 | Clark et al. | 439/587 |
| 4,983,132 | A * | 1/1991 | Weidler | 439/786 |
| 5,161,996 | A * | 11/1992 | Locati | 439/374 |
| 5,310,364 | A * | 5/1994 | Hooper et al. | 439/724 |
| 6,095,826 | A * | 8/2000 | Potters | 439/79 |
| 6,290,551 | B1 * | 9/2001 | Nguyen | 439/724 |
| 6,394,842 | B1 * | 5/2002 | Sakurai et al. | 439/607.25 |
| 7,798,852 | B2 * | 9/2010 | Laurx et al. | 439/607.08 |
| 2011/0092103 | A1 * | 4/2011 | Dowhower et al. | 439/629 |

FOREIGN PATENT DOCUMENTS

| | | |
|---|---|---|
| DE | 34 41 416 | 5/1986 |
| FR | 2 611 318 | 8/1988 |
| WO | WO 2006/069338 | 6/2006 |

OTHER PUBLICATIONS

International Search Report, International Application No. PCT/US2010/002774, International Filing Date, Oct. 18, 2010.

* cited by examiner

*Primary Examiner* — James Harvey

(57) ABSTRACT

An electrical connector system includes a header connector that includes a header housing and a header contact. The header housing includes a header base and a header shroud extending from the header base. The header base includes a header contact opening. The header contact is held by the header base within the header contact opening. The system also includes a receptacle connector configured to mate with the header connector. The receptacle connector includes a receptacle housing and a receptacle contact that engages the header contact when the header and receptacle connectors are mated together. The receptacle housing includes a receptacle base and a receptacle shroud extending from the receptacle base. The receptacle base includes a receptacle contact opening. The receptacle contact is held by the receptacle base within the receptacle contact opening. The receptacle contact opening has a common size and shape to the header contact opening.

24 Claims, 5 Drawing Sheets

HOUSING BASE FOR AN ELECTRICAL CONNECTOR

BACKGROUND OF THE INVENTION

The subject matter herein relates generally to electrical connectors, and more particularly, to housings for electrical connectors.

Electrical connector systems are commonly used to interconnect electrical components together. For example, electrical connector systems are sometimes used to electrically connect two printed circuits (sometimes referred to as "circuit boards") together. To interconnect the printed circuits, an electrical connector of one of the electrical components is mated with an electrical connector of the other electrical component. As the electrical connectors are mated together, electrical contacts of the connectors engage each other to electrically connect the connectors, and thereby the electrical components, together.

The electrical connectors hold the electrical contacts in housings that include mating interfaces that mate together and mounting interfaces that mount on the electrical components. The electrical contacts typically extend through contact openings that extend through the mating and mounting interfaces of the housing. For example, the electrical contacts are held in the contact openings of the housing such that mating segments of the electrical contacts extend along the mating interface of the housing. Mounting segments of the electrical contacts extend along the mounting interface of the housing for engagement with the electrical component.

The housings of electrical connectors that mate together to electrically connect two electrical components are discrete components that have different geometries, for example different sizes and/or shapes. Because of the different geometry of the connector housings, an electrical performance of the connector housings varies, such as at the mounting interfaces of the two connector housings. For example, the different geometries may cause the mounting segments of the electrical contacts of one of the connectors to experience different impedance, more noise, more crosstalk, and/or more signal degradation than the mounting segments of the electrical contacts of the other connector. One example of a different geometry between two connector housings includes differently sized and/or shaped contact openings. The differently sized and/or shaped contact openings between the two connector housings may cause the electrical performance of the system to vary at the contact openings of the two connector housings. Moreover, the different geometries of the connector housings may increase a complexity of the system and/or may increase a difficulty and/or cost of fabricating the connector housings.

BRIEF DESCRIPTION OF THE INVENTION

In one embodiment, an electrical connector system includes a header connector that includes a header housing and a header contact. The header housing includes a header base and a header shroud extending from the header base. The header base includes a header contact opening. The header contact is held by the header base within the header contact opening. The system also includes a receptacle connector configured to mate with the header connector. The receptacle connector includes a receptacle housing and a receptacle contact that engages the header contact when the header and receptacle connectors are mated together. The receptacle housing includes a receptacle base and a receptacle shroud extending from the receptacle base. The receptacle base includes a receptacle contact opening. The receptacle contact is held by the receptacle base within the receptacle contact opening. The receptacle contact opening has a common size and shape to the header contact opening.

In another embodiment, an electrical connector is provided for mounting on a printed circuit. The electrical connector includes an electrical contact having a mounting segment, a base segment, and a mating segment. The mounting segment is configured to engage the printed circuit. The mating segment is configured to engage a mating contact of a mating connector. The electrical connector also includes a housing having a base and a shroud. The base includes a shroud side, a mounting side, and a contact opening. The mounting side of the base is configured to be mounted on the printed circuit. The base segment of the electrical contact is held by the base within the contact opening such that the mating segment extends outward from the shroud side of the base. The shroud is a discrete component from the base that is separably mounted on the base. The shroud extends outward from the shroud side of the base and around the mating segment of the electrical contact.

In another embodiment, a kit is provided for assembling an electrical connector. The kit includes a base having a contact opening, a header contact configured to be held within the contact opening of the base, and a header shroud configured to be mounted on the base. The kit also includes a receptacle contact configured to be held within the contact opening of the base, and a receptacle shroud configured to be mounted on the base, wherein the header contact and the header shroud can be selectively assembled with the base to define a header connector, and the receptacle contact and receptacle shroud can be selectively assembled with the base to define a receptacle connector.

DETAILED DESCRIPTION OF THE INVENTION

Figure 1:
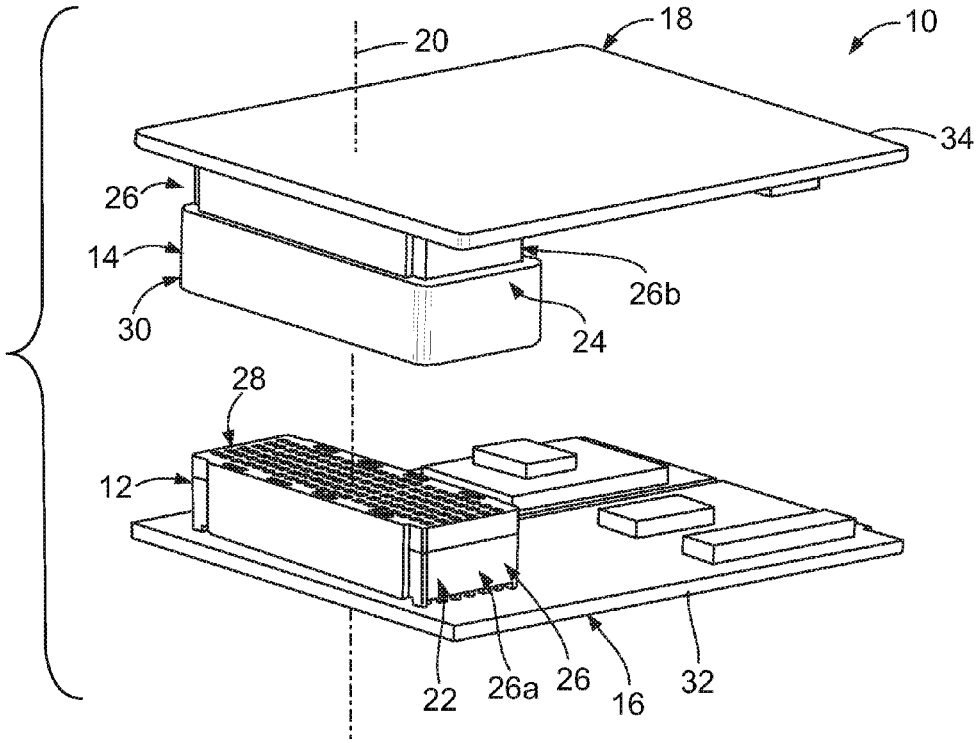
FIG. 1 is a perspective view of an exemplary embodiment of an electrical connector system illustrating a receptacle connector and a header connector of the system as unmated.

FIG. 1 is a perspective view of an exemplary embodiment of an electrical connector system 10 illustrating a receptacle connector 12 and a header connector 14 that may be directly connected, or mated, together. The electrical connector system 10 includes the receptacle connector 12 and the header connector 14, which are each electrically connected to, and mounted on, a respective printed circuit 16 and 18. A mating axis 20 extends through both the receptacle connector 12 and the header connector 14. The connectors 12 and 14 can be mated together in a direction parallel to and along the mating axis 20. When mated, an electrical connection is established between the receptacle connector 12 and the header connector 14. An electrical connection is thereby established between the printed circuits 16 and 18 via the connectors 12 and 14 for transferring electrical power, electrical signals, and/or electrical ground between the printed circuits 16 and 18. The receptacle connector 12 and the header connector 14 may each be referred to herein as an "electrical connector" and/or as a "mating connector".

The connectors 12 and 14 include respective housings 22 and 24. The housings 22 and 24 include a base 26 and respective shrouds 28 and 30. As will be described below, in the exemplary embodiment the base 26 is interchangeable with the connectors 12 and 14. Specifically, a specific base 26 may be used as a component of the receptacle connector 12 or as a component of the header connector 14. In other words, in the exemplary embodiment, the housing 22 of the receptacle connector 12 includes a base 26*a* that is identical to the base 26*b* of the housing 24 of the header connector 14.

Optionally, either the receptacle connector 12 or the header connector 14 may be in a fixed position and only the other of the receptacle connector 12 and the header connector 14 is moved along the mating axis 20 to mate the connectors 12 and 14 together. For example, the receptacle connector 12 and the printed circuit 16 may be fixed within an electronic device (not shown) such as, but not limited to, a host device, a computer, a network switch, a computer server, and/or the like, while the header connector 14 may be part of an external device (not shown) being electrically connected to the electronic device, or vice versa.

In the exemplary embodiment, the printed circuits 16 and 18 extend parallel to each other in different planes when the connectors 12 and 14 are mated together. Alternatively, the printed circuits 16 and 18 have any other orientation, location, position, and/or the like relative to each other when the connectors 12 and 14 are mated together. For example, in some alternative embodiments, the printed circuits 16 and 18 extend orthogonally to each other when the connectors 12 and 14 are mated together. Moreover, and for example, in some alternative embodiments the printed circuits 16 and 18 extend coplanar to each other when the connectors 12 and 14 are mated together. In other words, in some alternative embodiments the printed circuits 16 and 18 extend approximately parallel to each other in generally the same plane, such that edges of the printed circuits 16 and 18 face each other.

As used herein, the term "printed circuit" is intended to mean any electric circuit in which the conducting connections have been printed or otherwise deposited in predetermined patterns on an electrically insulating substrate. Substrates 32 and 34 of the printed circuits 16 and 18, respectively, may each be a flexible substrate or a rigid substrate. Each of the substrates 32 and 34 may be fabricated from and/or include any material(s), such as, but not limited to, ceramic, epoxy-glass, polyimide (such as, but not limited to, Kapton® and/or the like), organic material, plastic, polymer, and/or the like. In some embodiments, the substrate 32 and/or the substrate 34 is a rigid substrate fabricated from epoxy-glass, such that the respective printed circuit 16 and/or 18 is what is sometimes referred to as a "circuit board".

Figure 2:
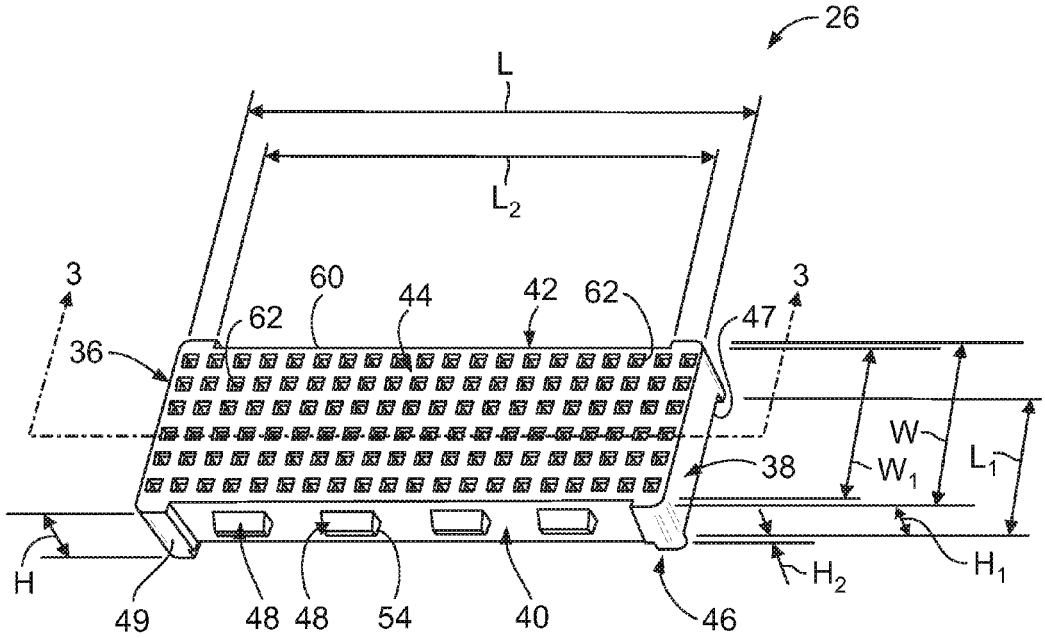
FIG. 2 is a perspective view of an exemplary embodiment of a housing base of the connectors shown in FIG. 1.

FIG. 2 is a perspective view of an exemplary embodiment of the base 26. The base 26 extends a length L from an end 36 to an opposite end 38, and a width W from a side 40 to an opposite side 42. The base 26 extends a height H from a shroud side 44 to a mounting side 46. Each of the sides 40 and 42 connects the shroud side 44 to the mounting side 46. The mounting side 46 of the base 26 is configured to be mounted on the printed circuits 16 and 18 (FIG. 1). The base 26 is configured to be connected to the shrouds 28 (FIGS. 1, 4, and 5) and 30 (FIGS. 1, 6, and 7) such that whichever shroud 28 or 30 is connected thereto extends outwardly from the shroud side 44 of the base 26. The base 26 may be fabricated using any suitable method, means, process, and/or the like, such as, but not limited to, using a molding process, using a casting process, using a machining process, and/or the like. The base 26 may be referred to herein as a "header base" and/or a "receptacle base". The sides 40 and 42 may each be referred to herein as an "intermediate side".

The mounting side 46 of the base 26 includes an optional groove 47 extending therein along at least portion of the length L of the base 26. The portion of the mounting side 46 within which the groove 47 extends defines another height $H_1$ of the base 26. The groove 47 has a height $H_2$. The groove 47 has a length $L_1$. The sides 40 and/or 42 include optional guide grooves 60 extending therein along portions of the length L of base 26. The portions of the sides 40 and 42 within which the guide grooves 60 extend defines another width $W_1$ of the base 26. Each of the guide grooves 60 has a height that, in the exemplary embodiment, is equal to the height $H_1$ of the base 26. Each of the guide grooves 60 has a length $L_2$. The grooves 60 define optional ears 49 of the base 26. In the exemplary embodiment, the base 26 has an overall shape of a general parallelpiped (for example the base 26 includes an overall parallelpiped shape if you discount the grooves 47 and 60 and the latch tabs 48 described below). But, the base 26 may have any other overall shape that enables the base 26 to function as described and/or illustrated herein.

The base 26 includes latch tabs 48 that are configured to cooperate with latch arms 50 (FIGS. 4 and 5) and 52 (FIGS. 6 and 7) of the shrouds 28 and 30, respectively, to hold the shrouds 28 and 30 on the base 26. In the exemplary embodiment, the latch tabs 48 are located on the sides 40 and 42. Specifically, four latch tabs 48 extend outward from the side 40 and four latch tabs 48 extend outward from the side 42. Each latch tab 48 includes a shoulder 54 that is configured to be engaged by hooks (not shown) of the shrouds 28 and 30, respectively. Each guide groove 60 is configured to receive the latch arms 50 and 52 therein. The guide grooves 60 facilitate aligning the base 26 with a shroud 28 or 30 that is being mounted on the base 26.

In addition or alternative to the latch tabs 48 and/or the shoulders 54, the base 26 may include any other structure for holding the shrouds 28 and 30 on the base 26, such as, but not limited to, an indentation, an opening, a latch arm, a detent, a hook, and/or the like. The base 26 may, in addition or alternative to the sides 40 and/or 42, include one or more latch tabs 48 at other locations thereof. Moreover, each side 40 and 42 may include any number of the latch tabs 48 and the base 26 may include any number of latch tabs 48 overall.

The base 26 includes a plurality of contact openings 62 for holding electrical contacts. The contact openings 62 extend through the shroud side 44, through the mounting side 46, and completely through the base 26 therebetween. Each contact opening 62 is configured to hold an electrical contact 64 (FIGS. 4 and 5) of the receptacle connector 12. Each contact opening 62 is also configured to hold an electrical contact 66 (FIGS. 6 and 7) of the header connector 14. Specifically, each contact opening 62 has a size and shape that enables the contact opening 62 to hold both an electrical contact 64 of the receptacle connector 12 and an electrical contact 66 of the header connector 14, albeit not at the same time. Accordingly, the electrical contacts 64 and 66 are interchangeable with the base 26 such that a specific base 26 may be used as a component of the receptacle connector 12 or as a component of the header connector 14. The base 26 may include any number of contact openings 62 for holding any number of electrical contacts.

Figure 3:
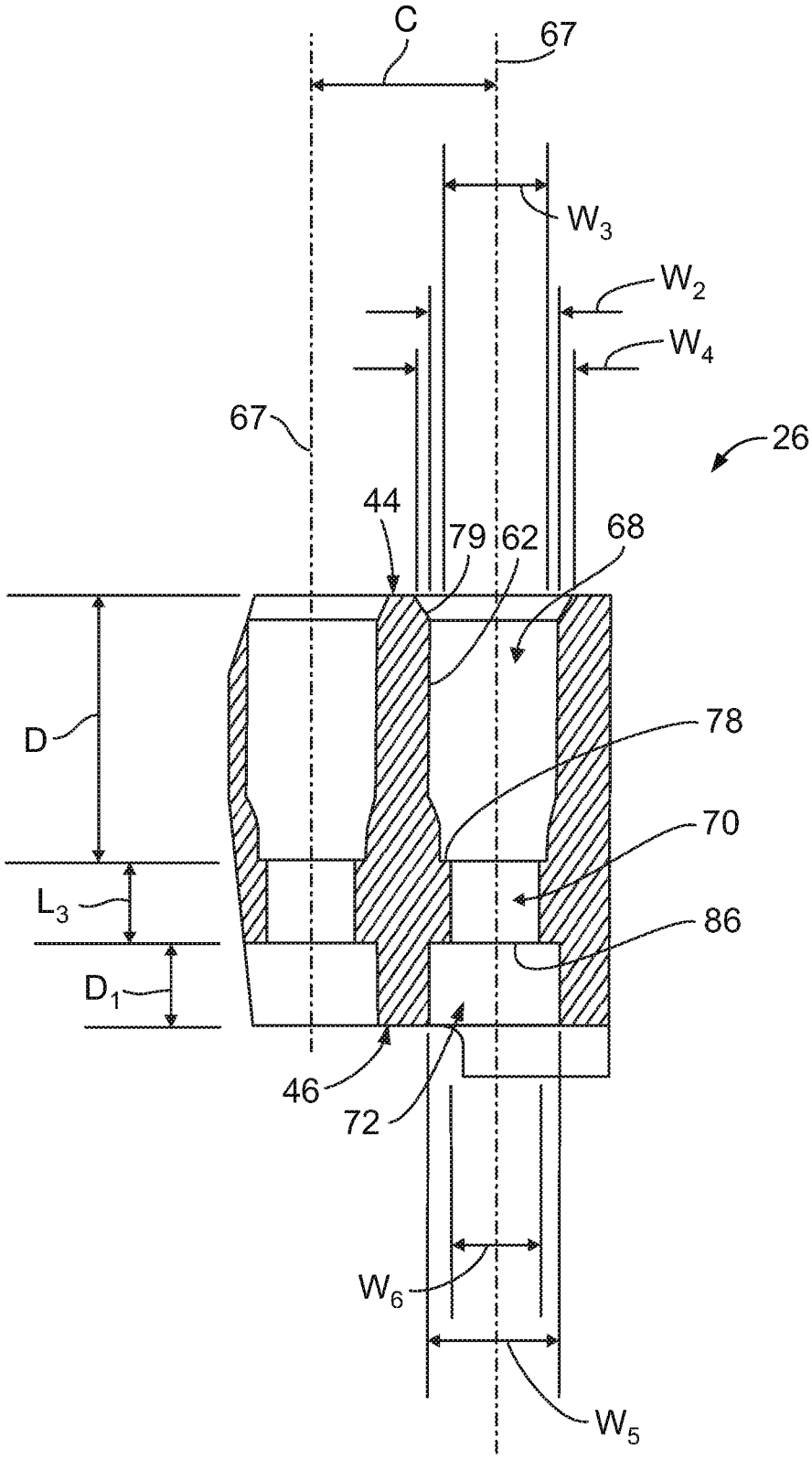
FIG. 3 is a portion of a cross section of the base shown in FIG. 2 taken along line 3-3 of FIG. 2.

FIG. 3 is a portion of a cross section of the base 26 taken along line 3-3 of FIG. 2. FIG. 3 illustrates an exemplary embodiment of one of the contact openings 62. The contact opening 62 extends through the base 26 along a central longitudinal axis 67. A centerline distance C is defined between the central longitudinal axis 67 of the contact opening 62 and the central longitudinal axis 67 of an adjacent contact opening 62, which is partially shown in FIG. 3. The exemplary embodiment of the contact opening 62 shown in FIG. 3 includes a shroud side segment 68, an intermediate segment 70, and a mounting side segment 72. The shroud side segment 68 extends into the base 26 through the shroud side 44 and toward the mounting side 46. The mounting side segment 72 extends into the base 26 through the mounting side 46 and toward the shroud side 44. The intermediate segment 70 of the contact opening 62 extends between, and fluidly connects, the shroud side segment 68 and the mounting side segment 72.

The shroud side segment 68 includes a width $W_2$ and extends a depth D to a ledge 78. Adjacent the ledge 78, the shroud side segment 68 of the contact opening 62 optionally tapers to a width $W_3$ that is smaller than the width $W_2$. The shroud side segment 68 includes an optional chamfer 79 at the shroud side 44 of the base 26. The chamfer 79 defines a width $W_4$ of the shroud side segment 68. The mounting side segment 72 includes a width $W_5$ and extends a depth $D_1$ to a ledge 86. The intermediate segment 70 includes a width $W_6$ and extends a length $L_3$ from the shroud side segment 68 to the mounting side segment 72. In the exemplary embodiment, the shroud side, intermediate, and mounting side segments 68, 70, and 72, respectively, have rectangular cross-sectional shapes. For example, the rectangular shape of the shroud side segment 68 can be seen in FIG. 2. But, the segments 68, 70, and 72 of each contact opening 62 may each include any other shape.

When the contact opening 62 holds an electrical contact 64 of the receptacle connector 12, the ledge 78 is configured to engage one or more flanges 90 (FIG. 4) of the electrical contact 64 to facilitate preventing the electrical contact 64 from being inadvertently removed from the contact opening 62 through the mounting side 46. In the exemplary embodiment, the tapered portion of the contact opening 62 that defines the width $W_3$ engages the flange 90 of the electrical contact 64 in an interference (or clearance) fit to hold the electrical contact 64 within the contact opening 62. Similarly, when the contact opening 62 holds an electrical contact 66 of the header connector 14, the ledge 78 is configured to engage one or more flanges 92 (FIG. 6) of the electrical contact 66 to facilitate preventing the electrical contact 66 from being inadvertently removed through the mounting side 46. In the exemplary embodiment, the tapered portion of the contact opening 62 that defines the width $W_3$ engages the flange 92 of the electrical contact 66 in an interference (or clearance) fit to hold the electrical contact 66 within the contact opening 62.

The intermediate segment 70 of the contact opening 62 is configured to hold a base segment 74 (FIG. 4) of a corresponding one of the electrical contacts 64 (FIGS. 4 and 5) of the receptacle connector 12 (FIGS. 1, 4, and 5) therein. The intermediate segment 70 of the contact opening 62 is also configured to hold a base segment 76 (FIG. 6) of a corresponding one of the electrical contacts 66 (FIGS. 6 and 7) of the header connector 14 (FIGS. 1, 6, and 7) therein, albeit not at the same time as the base segment 74.

Figure 8:
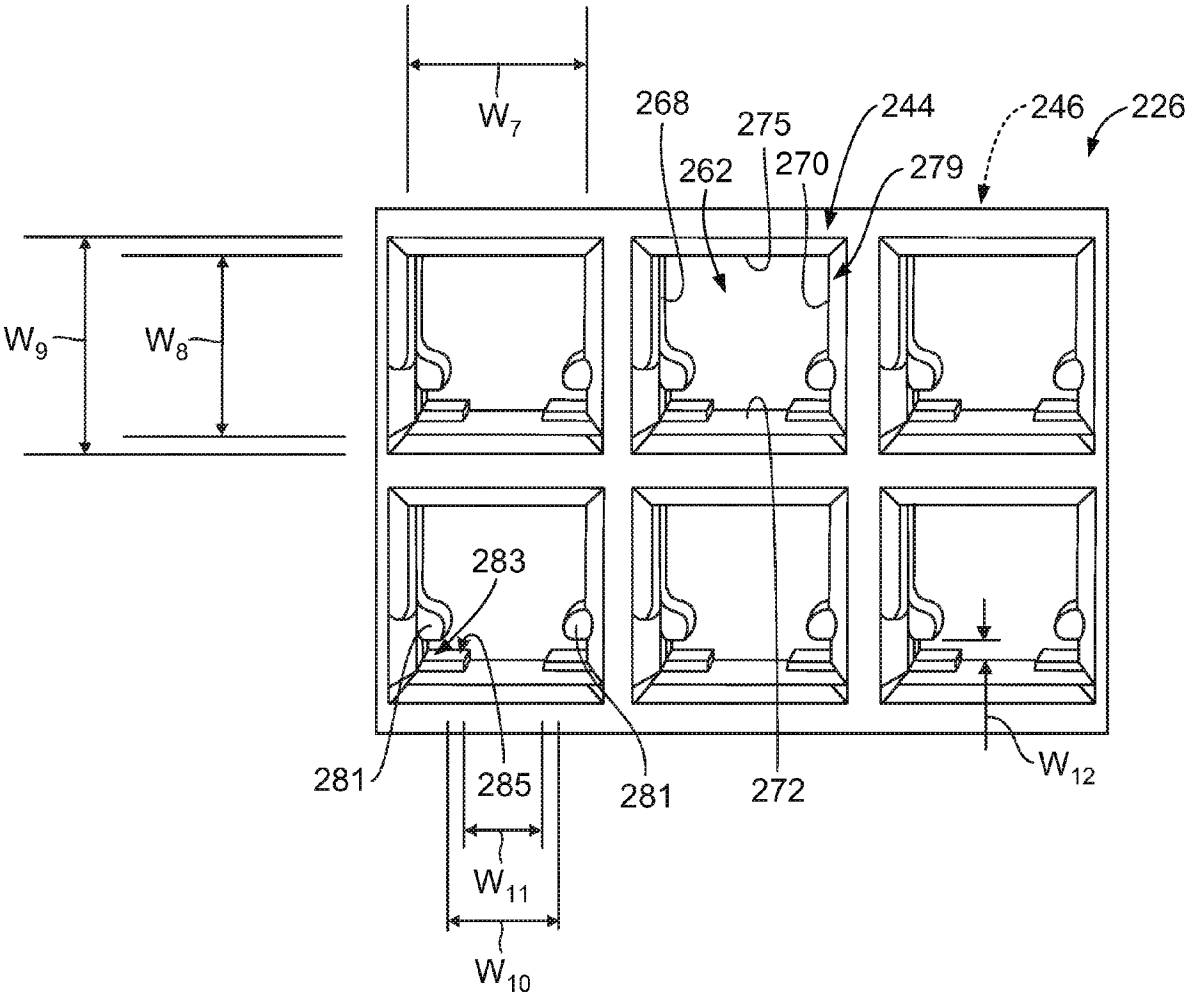
FIG. 8 is a plan view of a portion of an exemplary alternative embodiment of a housing base.

The size and shape of the contact opening 62 shown herein is meant as exemplary only. In addition or alternative to the sizes and shapes shown in FIGS. 2-4 and 6, each contact opening 62 may include any other size and/or shape for holding an electrical contact having any size and/or shape. For example, one or more of the contact openings 62 may not include a shroud side segment 68, an intermediate segment 70, and/or a mounting side segment 72. Moreover, and for example, the shroud side segment 68, the intermediate segment 70, and/or the mounting side segment 72 of one or more of the contact openings 62 may include a different size and/or shape than the size and shapes shown and/or described herein. Furthermore, one example of alternative sizes and shapes of the contact opening 62 is illustrated in FIG. 8. The contact opening 62 is also not limited to holding the electrical contacts 64 and 66 using the interference (or clearance) fit. Rather, the contact opening 62 may additionally or alternatively hold the electrical contacts 64 and 66 using any other structure, means, and/or the like, such as, but not limited to, a snap-fit connection, adhesive, fasteners, an indentation, an opening, a shoulder, a detent, and/or the like.

In the exemplary embodiment, each contact opening 62 of the base 26 includes the same size and shape. Alternatively, one or more of the contact openings 62 includes a different size and/or shape than one or more other contact openings 62. As should be apparent from FIG. 2, in the exemplary embodiment, the centerline distances C between each contact opening 62 and each adjacent contact opening 62 are equal. In other words, the centerline distances C are uniform throughout the pattern of contact openings 62 in the exemplary embodiment. But, alternatively the centerline distances C are not uniform throughout at least a portion of the pattern of contact openings 62. For example, in some alternative embodiments, one or more of the contact openings 62 may have different centerline distances C from two or more of the adjacent contact openings 62. Another example of a non-uniform pattern throughout at least a portion of the pattern of contact openings 62 includes wherein one or more of the contact openings 62 has a different centerline distance C from an adjacent contact opening 62 thereto than one or more of the other contact openings 62 has from a contact opening 62 that is adjacent thereto.

FIG. 8 is a plan view of a portion of an exemplary alternative embodiment of a housing base 226. FIG. 8 illustrates an exemplary alternative embodiment of a plurality of contact openings 262. Each contact opening 262 extends through the base 226. Specifically, the contact opening 262 extends through a shroud side 244 of the base 226, through a mounting side 246 of the base 226, and completely through the base 226 therebetween. The contact opening 262 is defined by opposing side walls 268 and 270, and opposing side walls 272 and 275. A width $W_7$ of the contact opening 262 is defined between the side walls 268 and 270, while a width $W_8$ of the contact opening 262 is defined between the side walls 272 and 275. The base 226 includes an optional chamfer 279 at the shroud side 244 of the base 226. The chamfer 279 defines a width $W_9$ of the contact opening 262. The base 226 includes one or more extensions 281 that extend into the contact opening 262. In the exemplary embodiment, the base 226 includes two extensions 281 that extend from the opposing side walls 268 and 270. But, the base 226 may include any number of extensions 281 within each of the contact openings 262. Moreover, each extension 281 may extend from any of the side walls 268, 270, 272, and 275. Slots 283 are defined between each extension 281 and a corresponding pad 285 on the side wall 272. Widths $W_{10}$ and $W_{11}$ of the contact opening 262 are defined between the free ends of the extensions 281 and between ends of the pads 285, respectively. Each slot 283 has a width $W_{12}$.

The contact opening 262 is configured to hold one of the electrical contacts 64 (FIGS. 4 and 5) of the receptacle connector 12 (FIGS. 1, 4, and 5) therein. The contact opening 262 is also configured to hold one of the electrical contacts 66 (FIGS. 6 and 7) of the header connector 14 (FIGS. 1, 6, and 7) therein, albeit not at the same time as the electrical contact 64. In the exemplary embodiment of FIG. 8, the electrical contacts 64 and 66 include contact tabs (not shown) that are received within corresponding ones of the slots 283. The contact tabs of the electrical contacts 64 and 66 engage the extensions 281 and pads 285 in an interference (or clearance) fit to hold the electrical contact 64 or 66 within the contact opening 262.

Figure 4:
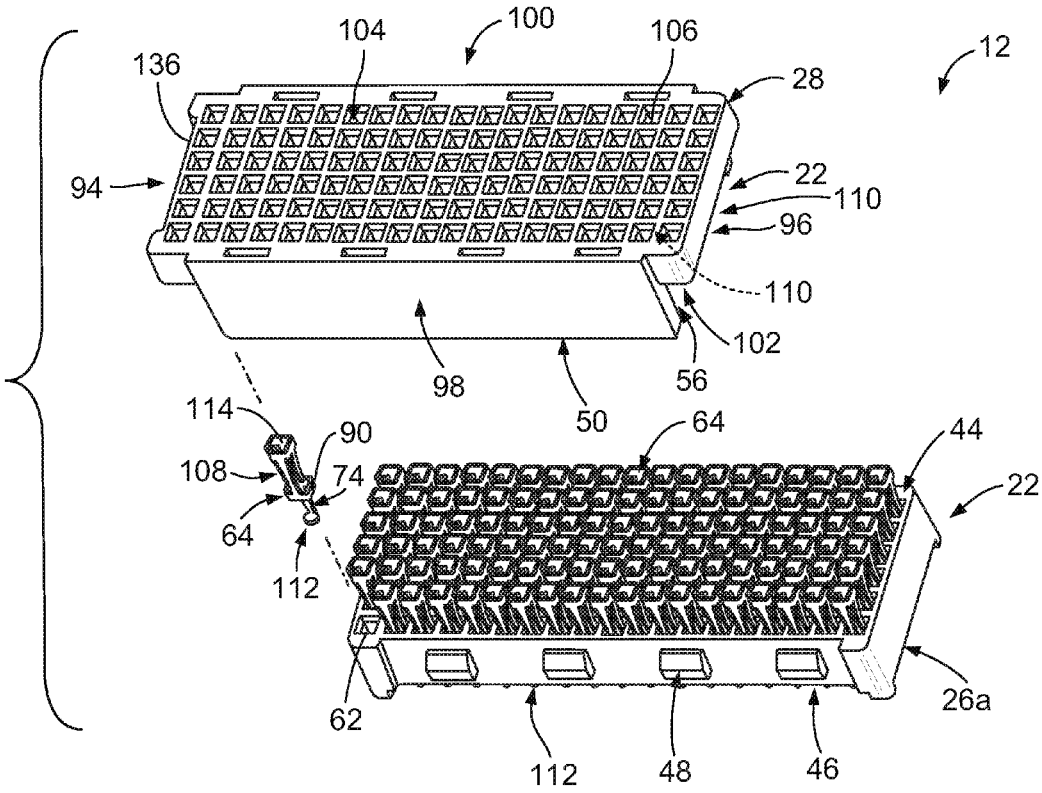
FIG. 4 is a partially exploded perspective view of an exemplary embodiment of the receptacle connector shown in FIG. 1.

FIG. 4 is a partially exploded perspective view of an exemplary embodiment of the receptacle connector 12. The receptacle connector 12 includes the housing 22 and the electrical contacts 64. The housing 22 includes the base 26*a* and the shroud 28. The shroud 28 extends a length from an end 94 to an opposite end 96, and a width from a side 98 to an opposite side 100. The shroud 28 includes a base side 102 and a mating side 104. The shroud 28 includes a plurality of shroud openings 106 that extend through the mating side 104, through the base side 102, and completely through the shroud 28 therebetween. Each shroud opening 106 is configured to receive a mating segment 108 of a corresponding one of the electrical contacts 64. The shroud 28 may include any number of shroud openings 106 for any number of mating segments 108. The housing 22 may be referred to herein as a "receptacle housing". The electrical contacts 64 may be referred to herein as "receptacle contacts" and/or "mating contacts". The shroud 28 may be referred to herein as a "receptacle shroud".

The shroud 28 is a discrete component from the base 26*a* that is configured to be separably mounted on the base 26*a*. As used herein, the term "discrete" is intended to mean constituting a separate part or component. The shroud 28 may be separably mounted on the base 26*a* using any suitable method, process, structure, means, configuration, arrangement, and/or the like. In the exemplary embodiment, the shroud 28 includes the latch arms 50 that cooperate with the latch tabs 48 of the base 26*a* to hold the shroud 28 on the base 26*a*. Specifically, each of the sides 98 and 100 includes a latch arm 50 extending therefrom in a direction outward from the base side 102. The latch arms 50 include the hooks (not shown). A cavity 110 is defined between the latch arms 50.

In addition or alternative to the latch arms 50 and/or the hooks, the shroud 28 may include any other structure for holding the shroud 28 on the base 26*a*, such as, but not limited to, an indentation, an opening, a latch tab, a shoulder, a detent, and/or the like. The shroud 28 may, in addition or alternative to the sides 98 and/or 100, include one or more latch arms 50 at other locations thereof. Moreover, each side 98 and 100 may include any number of the latch arms 50 and the shroud 28 may include any number of latch arms 50 overall.

Each of the electrical contacts 64 includes the mating segment 108, a mounting segment 112, and the base segment 74. The base segment 74 extends between the mating segment 108 and the mounting segment 112. Each electrical contact 64 includes one or more of the flanges 90. The base segment 74 of each electrical contact 64 is held within the intermediate segment 70 (FIG. 3) of the corresponding contact opening 62 of the base 26*a*. When held in the contact openings 62 as shown in FIG. 4, the mating segments 108 of the electrical contacts 64 extend outward from the shroud side 44 of the base 26*a*, while the mounting segments 112 extend outward from the mounting side 46 of the base 26*a* for engagement with the printed circuit 16 (FIG. 1).

In the exemplary embodiment, the mating segment 108 of each electrical contact 64 includes a socket 114. The socket 114 is configured to engageably receive a mating segment 116 (FIGS. 6 and 7) of a corresponding one of the electrical contacts 66 of the header connector 14 therein when the connectors 12 and 14 are mated together. Alternatively, the mating segments 108 of one or more of the electrical contacts 64 includes any other structure for mating with the corresponding electrical contact 66, such as, but not limited to, a pin, a plug, an arm, and/or the like.

Figure 5:
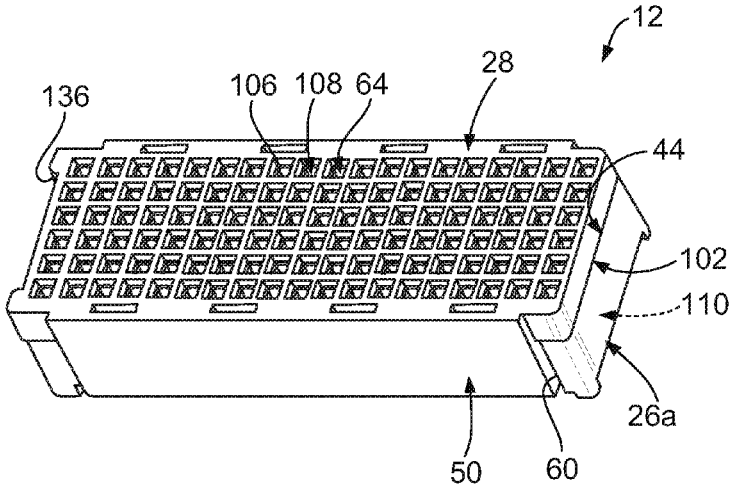
FIG. 5 is a perspective view of the receptacle connector shown in FIG. 4 illustrating an exemplary embodiment of a shroud separably mounted on the base shown in FIG. 2.

FIG. 5 is a perspective view of the receptacle connector 12 illustrating the shroud 28 separably mounted on the base 26*a*. The base side 102 of the shroud 28 is engaged with the shroud side 44 of the base 26*a* such that a portion of the shroud 28 extends outwardly from the shroud side 44 of the base 26*a*. The mating segment 108 of each electrical contact 64 extends within a corresponding one of the shroud openings 106 of the shroud 28. Accordingly, portions of the shroud 28 extend around the mating segments 108. The base 26*a* is received within the cavity 110 defined between the latch arms 50 such that the latch arms 50 straddle the base 26*a* and such that the latch arms 50 are received within the guiding grooves 60 of the base 26*a*. The hooks (not shown) of the latch arms 50 are engaged with the latch tabs 48 (FIGS. 2 and 4) of the base 26*a* to hold the shroud 28 on the base 26*a*. In the exemplary embodiment, the latch arms 50 are resilient such that the latch arms 50 engage the latch tabs 48 in a snap-fit connection. Accordingly, in the exemplary embodiment, the shroud 28 is separably mounted on the base 26*a* via a snap-fit connection. In addition or alternative to the snap-fit connection, the shroud 28 may be separably mounted on the base 26*a* using any other type of connection, such as, but not limited to, using an interference (or clearance) fit, using threaded and/or other fasteners, and/or the like.

Figure 6:
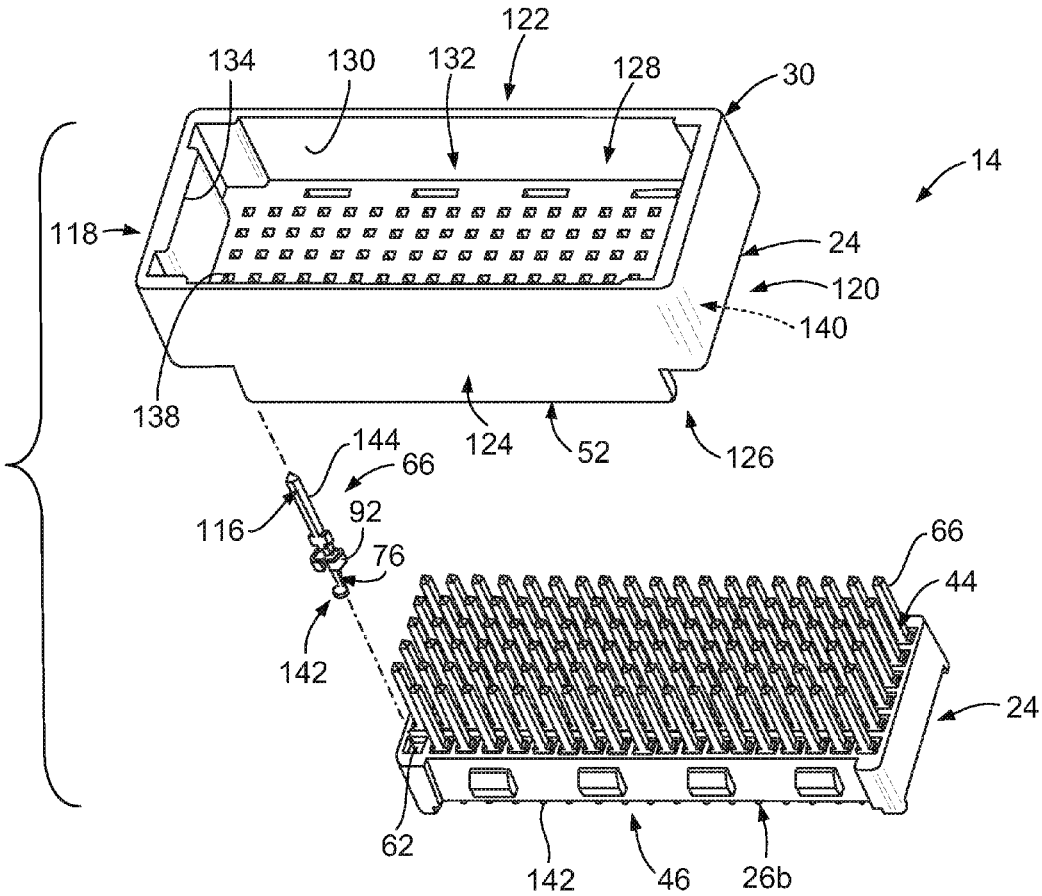
FIG. 6 is a partially exploded perspective view of an exemplary embodiment of the header connector shown in FIG. 1.

FIG. 6 is a partially exploded perspective view of an exemplary embodiment of the header connector 14. The header connector 14 includes the housing 24 and the electrical contacts 66. The housing 24 includes the base 26*b* and the shroud 30, which extends a length from an end 118 to an opposite end 120. The shroud 30 extends a width from a side 122 to an opposite side 124, and includes a base side 126 and a mating side 128. A peripheral wall 130 extends outwardly at the mating side 128. The wall 130 defines a receptacle 132 that receives the mating side 104 (FIGS. 4 and 5) of the shroud 28 (FIGS. 1, 4, and 5) of the receptacle connector 12 (FIGS. 1, 4, and 5). The wall 130 includes an optional keying extension 134 that cooperates with a keying recess 136 (FIGS. 4 and 5) extending within the shroud 28 of the receptacle connector 12, or alternatively vice versa. A plurality of shroud openings 138 extend through the mating side 128, through the base side 126, and completely through the shroud 30 therebetween. The housing 24 may be referred to herein as a "header housing" and/or a "mating housing", the electrical contacts 66 may be referred to herein as "header contacts" and/or "mating contacts", and the shroud 30 may be referred to herein as a "header shroud".

The shroud 30 is a discrete component from the base 26*b* that is configured to be separably mounted on the base 26*b*. To hold the shroud 30 on the base 26*b*, the exemplary embodiment of the shroud 30 includes the latch arms 52, which include the hooks (not shown). Specifically, each of the sides 122 and 124 includes a latch arm 52 extending therefrom in a direction outward from the base side 126. Additionally or alternatively, any suitable other method, process, structure, means, configuration, arrangement, and/or the like may be used to mount the shroud 30 on the base 26*b*. A cavity 140 is defined between the latch arms 52. In addition or alternative to the latch arms 52 and/or the hooks, the shroud 30 may include any other structure for holding the shroud 30 on the base 26*b*. Examples of other structures for holding the shroud 30 on the base 26*b* include, but are not limited to, an indentation, an opening, a latch tab, a shoulder, a detent, and/or the like. The shroud 30 may include one or more latch arms 52 at other locations in addition or alternative to the sides 122 and/or 124. Each side 122 and 124 may include any number of the latch arms 52. The shroud 30 may include any number of latch arms 52 overall.

In addition to the mating segments 116 and the base segments 76, the electrical contacts 66 include mounting segments 142. The base segment 76 of each electrical contact 66 extends between the mating segment 116 and the mounting segment 142. One or more of the flanges 92 extend from each of the electrical contacts 66. The intermediate segment 70 (FIG. 3) of the corresponding contact opening 62 of the base 26*b* holds the base segment 76 of each electrical contact 66. The mating segments 116 of the electrical contacts 66 extend outward from the shroud side 44 of the base 26*b*. The mounting segments 142 extend outward from the mounting side 46 of the base 26*b* for engagement with the printed circuit 18 (FIG. 1).

The exemplary embodiment of the mating segment 116 of each electrical contact 66 includes a pin 144. The pin 144 is configured to be engageably received within the socket 114 (FIG. 4) of a corresponding one of the electrical contacts 64 of the receptacle connector 12. In some alternative embodiments, the mating segment 116 of one or more of the electrical contacts 66 includes any other structure for mating with the corresponding electrical contact 64, such as, but not limited to, a pin, a plug, an arm, and/or the like.

Figure 7:
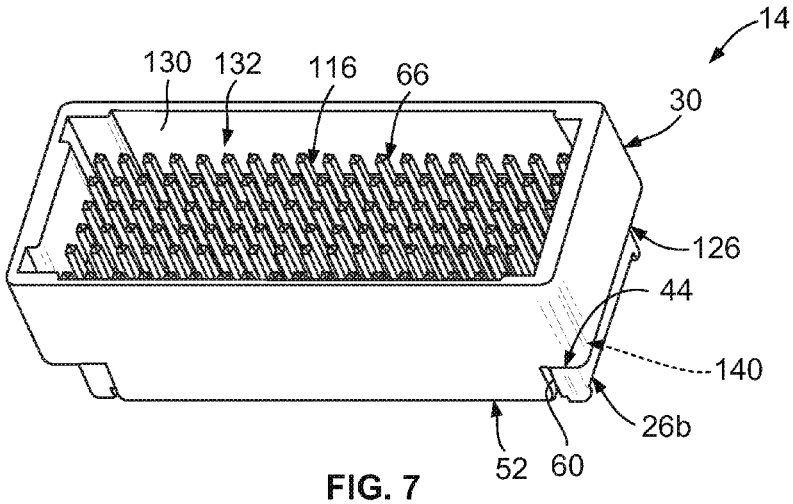
FIG. 7 is a perspective view of the header connector shown in FIG. 6 illustrating an exemplary embodiment of a shroud separably mounted on the base shown in FIG. 2.

FIG. 7 is a perspective view of the header connector 14 illustrating the shroud 30 separably mounted on the base 26*b*. The base side 126 of the shroud 30 is engaged with the shroud side 44 of the base 26*b* such that a portion of the shroud 30 extends outwardly from the shroud side 44 of the base 26*b*. The mating segment 116 of each electrical contact 66 extends through a corresponding one of the shroud openings 138 (FIG. 6) of the shroud 30 and into the receptacle 132. Accordingly, the peripheral wall 130 of the shroud 30 extends around the mating segments 116. The base 26*b* is received within the cavity 140 defined between the latch arms 52 such that the latch arms 52 straddle the base 26*b* and such that the latch arms 52 are received within the guiding grooves 60 of the base 26*b*. The hooks (not shown) of the latch arms 52 are engaged with the latch tabs 48 (FIGS. 2 and 4) of the base 26*b* to hold the shroud 30 on the base 26*b*. In the exemplary embodiment, the latch arms 52 are resilient such that the latch arms 52 engage the latch tabs 48 in a snap-fit connection. Accordingly, in the exemplary embodiment, the shroud 30 is separably mounted on the base 26*b* via a snap-fit connection. In addition or alternative to the snap-fit connection, the shroud 30 may be separably mounted on the base 26*b* using any other type of connection, such as, but not limited to, using an interference (or clearance) fit, using threaded and/or other fasteners, and/or the like. The shroud 30 may include any number of shroud openings 138 for receiving any number of mating segments 116.

Referring again to FIGS. 1, 4, and 6, as described above, the base 26 is interchangeable with the connectors 12 and 14. In the exemplary embodiment, the base 26*a* of the receptacle connector housing 22 is identical to the base 26*b* of the header connector housing 24. Accordingly, the sizes and shapes of the base 26*a* are identical to the base 26*b* in the exemplary embodiment. Moreover, a size and shape of each of the contact openings 62 of the base 26*a* is identical to a size and shape of the corresponding contact opening 62 of the base 26*b* in the exemplary embodiment. In some embodiments, the base 26*a* is fabricated from the same mold (not shown), the same casting (not shown), the same machining program and tooling (not shown), and/or the same materials as the base 26*b*.

In some alternative embodiments, a portion of the base 26*a* includes a different size and/or shape than a portion of the base 26*b*, so long as at least one contact opening 62 of the base 26*a* has a common size and shape to the corresponding contact opening 62 of the base 26*b*. A particular contact opening 62 of the base 26*a* corresponds to a particular contact opening 62 of the base 26*b* if the electrical contact 64 held by the particular contact opening 62 of the base 26*a* mates with the electrical contact 66 held by the particular contact opening 62 of the base 26*b*. As should be apparent from FIG. 2 and the description thereof provided above, sizes of the base 26 include but are not limited to, the lengths L, $L_1$, and $L_2$, the heights H, $H_1$, and $H_2$, the widths W and $W_1$, the height of the guide grooves 60, any size shown and/or described of the base 226, and/or the like. Shapes of the base 26 include, but are not limited to, the overall shape of the base 26, the overall shape of the base 226, the grooves 47 and 60, the latch tabs 48 (including, but not limited to, the number, relative spacing, location, shapes, and/or the like thereof), the ears 49, and the contact openings 62 (including the number, centerline spacing C, location, shapes, pattern, and/or the like thereof), the contact openings 262 (including the number, centerline spacing C, location, shapes, pattern, and/or the like thereof), and/or the like. Sizes of the contact openings 62 include, but are not limited to, the depths D and $D_1$, the widths $W_2$, $W_3$, $W_4$, $W_5$, $W_6$, $W_7$, $W_8$, $W_9$, $W_{10}$, $W_{11}$, $W_{12}$, the length $L_3$, and/or the like. Shapes of the contact openings 62 include, but are not limited to, the shapes of each of the segments 68, 70, 72 (whether the segments 68, 70, and/or 72 are included), the shapes of the contact openings 262, and/or the like. A "common size and shape" of two bases 26 is intended to mean that the two bases 26 share at least one identical size and/or shape that provide at least portions of the two bases 26 with substantially similar electrical performances. In some embodiments, a "common size and shape" of two contact openings 62 of two bases 26 is intended to mean that the two contact openings 62 share at least one identical size and/or shape that provides the two bases 26 with substantially similar electrical performances proximate the two contact openings 62.

The embodiments described and/or illustrated herein may provide an electrical connector system having an electrical performance that varies less between connector housings than at least some known electrical connector systems. The embodiments described and/or illustrated herein may provide an electrical connector system that is less complex than at least some known electrical connector systems. The embodiments described and/or illustrated herein may provide an electrical connector system having connector housings that are less difficult and/or less costly to fabricate than at least some known electrical connector systems.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "upper", "lower", "first", "second", "third," etc. are used merely as labels, and are not intended to impose numerical, orientational, and/or other requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector system comprising:

a header connector comprising a header housing and a header contact, the header housing comprising a header base and a header shroud extending from the header base, the header base comprising a header contact opening, the header contact being held by the header base within the header contact opening; and a receptacle connector configured to mate with the header connector, the receptacle connector comprising a receptacle housing and a receptacle contact that engages the header contact when the header and receptacle connectors are mated together, the receptacle housing comprising a receptacle base and a receptacle shroud extending from the receptacle base, the receptacle base comprising a receptacle contact opening, the receptacle contact being held by the receptacle base within the receptacle contact opening, wherein the receptacle contact opening has a common size and shape to the header contact opening, and wherein at least one of the header base or the receptacle base comprises a side wall that defines an exterior side of the header housing or receptacle housing, respectively.

2. The system according to claim 1, wherein the header base of the header housing has a common size and shape to the receptacle base of the receptacle housing.

3. The system according to claim 1, wherein the header base of the header housing is fabricated from at least one of the same mold, the same casting, and the same machining program as the receptacle base of the receptacle housing.

4. The system according to claim 1, wherein the header contact comprises header contacts and the header opening comprises header openings, each header contact being held within a corresponding one of the header openings, the receptacle contact comprising receptacle contacts and the receptacle opening comprising receptacle openings, each receptacle contact being held within a corresponding one of the receptacle openings, each receptacle contact engages a corresponding header contact when the header and receptacle connectors are mated together, wherein the receptacle and header contact openings that hold corresponding header and receptacle contacts have a common size and shape relative to each other.

5. The system according to claim 1, wherein the header shroud of the header housing is separably mounted on the header base.

6. The system according to claim 1, wherein the receptacle shroud of the receptacle housing is separably mounted on the receptacle base.

7. The system according to claim 1, wherein the receptacle contact of the receptacle connector comprises a socket and the header contact of the header connector comprises a pin that is configured to be received within the socket of the receptacle contact when the header and receptacle connectors are mated together.

8. The system according to claim 1, wherein the header base of the header connector comprises a shroud side and the header contact comprises a mating segment that extends outward from the shroud side of the header base, the header shroud extending outward from the shroud side of the header base such that the header shroud extends around the mating segment of the header contact.

9. The system according to claim 1, wherein the receptacle base of the receptacle connector comprises a shroud side and the receptacle contact comprises a mating segment that extends outward from the shroud side of the receptacle base, the receptacle shroud extending outward from the shroud side of the receptacle base such that the receptacle shroud extends around the mating segment of the receptacle contact.

10. The system according to claim 1, wherein the receptacle contact comprises a mating segment that extends outward from the receptacle base, the receptacle shroud comprising a shroud opening, the mating segment of the receptacle contact extending within the shroud opening.

11. An electrical connector for mounting on a printed circuit, comprising:

an electrical contact comprising a mounting segment, a base segment, and a mating segment, the mounting segment being configured to engage the printed circuit, the mating segment configured to engage a mating contact of a mating connector; and a housing comprising a base and a shroud, the base comprising a shroud side, a mounting side, and a contact opening, the mounting side of the base being configured to be mounted on the printed circuit, the base segment of the electrical contact being held by the base within the contact opening such that the mating segment extends outward from the shroud side of the base, the shroud being a discrete component from the base that is separably mounted on the base, the shroud extending outward from the shroud side of the base and around the mating segment of the electrical contact, wherein the base extends between, and is engaged with, the printed circuit and the shroud when the base is mounted on the printed circuit.

12. The connector according to claim 11, wherein the shroud comprises a base side engaged with the base, the shroud having a latching arm extending outward from the base side, the base comprising a latching tab, the latching arm of the shroud engaging the latching tab of the base to hold the shroud on the base.

13. The connector according to claim 11, wherein the shroud comprises a base side engaged with the base, the shroud having a pair of latching arms extending outward from the base side, the latching arms defining a cavity therebetween, the base being received within the cavity such that the latching arms straddle the base.

14. The connector according to claim 11, wherein the shroud is separably mounted on the base via a snap-fit connection.

15. The connector according to claim 11, wherein the base comprises an intermediate side that connects the shroud and mounting sides, the intermediate side comprising a guide groove, the shroud comprising a latching arm that is received within the guide groove of the intermediate side of the base.

16. The connector according to claim 11, wherein the shroud comprises a shroud opening, the mating segment of the electrical contact extending within the shroud opening.

17. The connector according to claim 11, wherein the shroud comprises a receptacle configured to receive a mating housing of the mating connector therein.

18. The connector according to claim 11, wherein the electrical contact comprises a socket that is configured to receive the mating contact of the mating connector therein.

19. The connector according to claim 11, wherein the electrical contact comprises a pin that is configured to be received within a socket of the mating contact of the mating connector.

20. A kit for assembling an electrical connector, said kit comprising:

a base comprising a contact opening and a side wall;

a header contact configured to be held within the contact opening of the base;

a header shroud configured to be mounted on the base;

a receptacle contact configured to be held within the contact opening of the base; and a receptacle shroud configured to be mounted on the base, wherein the header contact and the header shroud can be selectively assembled with the base to define a header connector, and the receptacle contact and receptacle shroud can be selectively assembled with the base to define a receptacle connector, and wherein the side wall of the base defines an exterior side of a housing defined by the base and the header shroud when the base is selectively assembled with the header shroud or defined by the base and the receptacle shroud when the base is selectively assembled with the receptacle shroud.

21. The system according to claim 1, wherein at least one of the header connector or the receptacle connector is configured to be mounted on a printed circuit, the side wall extending non-parallel to the printed circuit when the at least one of the header connector or the receptacle connector is mounted on the printed circuit.

22. The system according to claim 1, wherein at least one of the header connector or the receptacle connector is configured to be mounted on a printed circuit, at least one of the head base or the receptacle base extending between, and being engaged with, the printed circuit and the header shroud or receptacle shroud, respectively.

23. The system according to claim 1, wherein the header contact comprises header contacts, the header base comprising a single unitary body that holds all of the header contacts of the header connector.

24. The connector according to claim 11, wherein the base comprises a side wall that defines an exterior side of the housing, the side wall extending non-parallel to the printed circuit when the base is mounted to the printed circuit.

* * * * *